US006699023B2

(12) United States Patent
Naito et al.

(10) Patent No.: US 6,699,023 B2
(45) Date of Patent: Mar. 2, 2004

(54) MULTI-STAGE VACUUM PUMP

(75) Inventors: Yoshihiro Naito, Nagoya (JP); Kazuo Noso, Toyoake (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/307,995

(22) Filed: Dec. 3, 2002

(65) Prior Publication Data

US 2003/0133817 A1 Jul. 17, 2003

(30) Foreign Application Priority Data

Dec. 3, 2001 (JP) ..... 2001-369026

(51) Int. Cl.[7] ..... F04C 18/18; F04C 25/02
(52) U.S. Cl. ..... 418/9
(58) Field of Search ..... 418/9

(56) References Cited

U.S. PATENT DOCUMENTS

| | | | | |
|---|---|---|---|---|
| 1,531,607 A | * | 3/1925 | Green | 418/9 |
| 4,828,467 A | | 5/1989 | Brown | 418/270 |
| 5,356,275 A | * | 10/1994 | Brenner et al. | 418/9 |
| 6,123,526 A | * | 9/2000 | Chen et al. | 418/9 |

FOREIGN PATENT DOCUMENTS

| | | |
|---|---|---|
| EP | 0 135 257 | 3/1985 |
| GB | 2 088 957 | 6/1982 |
| JP | 3051515 | 3/2000 |

* cited by examiner

*Primary Examiner*—John J. Vrablik
(74) *Attorney, Agent, or Firm*—Oblon, Spivak, McClelland, Maier & Neustadt, P.C.

(57) ABSTRACT

The present invention provides a multi-stage vacuum pump which includes: a housing in which a plurality of pumping chambers are formed, the pumping chambers being arranged in series and being in fluid communication with one another, one of the pumping chambers which is at one end of the series acting as an initial stage pumping chamber, another of the pumping chamber which is at the other end of the series acting as a final stage pumping chamber, the housing being provided with an inlet port for sucking a gas from a space to be evacuated into the initial stage pumping chamber, the housing being provided with an outlet port for exhausting the gas from the final stage pumping chamber; Roots-type pump sections occupying the respective pumping chambers, each of the Roots-type pump sections having a pair of intermeshed Roots-type profile rotors; and a pair of shafts adapted for rotation within the housing about their lengthwise axes in contra-rotational direction, the pair of shafts being secured to the respective Roots-type profile rotors in each of the Roots-type pump sections, one end of each of the shafts being made immovable in its lengthwise direction, the other of each of the shafts being made expandable in its lengthwise direction.

3 Claims, 4 Drawing Sheets

MULTI-STAGE VACUUM PUMP

The present application is based on and claims priority under 35 U.S.C §119 with respect to Japanese Patent Application No. 2001-369026 on Dec. 3, 2001 (13th Year of Heisei), the entire content of which is incorporated herein by reference.

BACKGROUND OF THE INVENTION

1. Field of the Invention

The present invention is generally directed to a multi-stage vacuum pump and in particular to a multi-stage vacuum pump which is oil-free (dry) in their pumping chambers.

2. Prior Art

As Japanese Patent Publication No. 3051515 discloses, a conventional multi-stage vacuum pump of the type is constructed to have a plurality of in-series pumping chambers each of which accommodates a pair of intermeshing rotors which are all of a "Roots"-type profile and which are fixedly mounted on a pair of respective shafts. The pair of "Roots"-type profile rotors which are provided in each pumping chamber axe rotated therein to make a space evacuated which is connected to an inlet port or suck port of the pumping chamber by compressing a gas sucked from the space to be evacuated. While the rotors are being in rotation, a heat of compression is generated due to the gas compression. Such a compression heat is radiated from an outer surface of the housing to the atmosphere and is cooled down to a temperature by cooling water passing through a cooler secured, to the housing. Thus, the housing of the multi-stage vacuum pump becomes free from the possible temperature increase.

On the other hand, while the multi-stage vacuum pump is in operation, the pumping chambers are made substantially vacuumed, which causes less heat radiation to the gas in each of the pumping chambers from pair of "Roots"-type profile rotors and the respective pair of shafts, resulting in that each of the pair of "Roots"-type profile rotors and the respective pair of shafts becomes larger and larger in temperature increase degree when compared to the housing. Thus, the larger the temperature increase resulting from the compression heat, the larger the temperature difference between the housing and each of the pair of "Roots"-type profile rotors and the respective pair of shafts. Due to the fact that the housing is brought into thermal expansion in proportion to temperature increase, if the aforementioned temperature difference becomes larger above a specific value, the position of each of the pair of "Roots"-type profile rotors may vary relative to the housing.

In addition, though the multi-stage vacuum pump is designed to define, in each of the pumping chambers, an axial clearance having a fixed length between each of the "Roots"-type profile rotors and an inner surface of the pumping chamber, the fixed clearance length may become shorter and shorter due to the above-mentioned relatively large thermal expansion difference between the shaft and the housing. This results in, in extreme case, that the "Roots"-type profile rotors are brought into sliding engagement with the inner surface of the pumping chamber to generate uncomfortable noise or dreadful noise. Though enlarging or increasing the fixed clearance length makes the multi-stage vacuum pump free from such noises, the increased clearance length increases the amount of gas which flows back therethrough, resulting in lowering the total pump volume efficiency.

Thus, a need exists to provide a "Roots"-type multi-stage vacuum pump which is free from the above-described drawbacks.

SUMMARY OF THE INVENTION

Accordingly, in order to meet the above need to overcome the aforementioned drawbacks or problems, a first aspect of the present invention provides a multi-stage vacuum pump which comprises:

a housing in which a plurality of pumping chambers are formed, the pumping chambers being arranged in series and being in fluid communication with one another, one of the pumping chambers which is at one end of the series acting as an initial stage pumping chamber, another of the pumping chamber which is at the other end of the series acting as a final stage pumping chamber, the housing being provided with an inlet port for sucking a gas from a space to be evacuated into the initial stage pumping chamber, the housing being provided with an outlet port for exhausting the gas from the final stage pimping chamber;

Roots-type pump sections occupying the respective pumping chambers, each of the Roots-type pump sections having a pair of intermeshed Roots-type profile rotors; and a pair of shafts adapted for rotation within the housing about their lengthwise axes in contra-rotational direction, the pair of shafts being secured to the respective Roots-type profile rotors in each of the Roots-type pump sections, one end of each of the shafts being made immovable in its lengthwise direction, the other end of each of the shafts being made expandable in its lengthwise direction.

A second aspect of the present invention is to provide multi-stage vacuum pump whose gist is to modify the structure of the first aspect, wherein an axially defined clearance between an inner surface of each of the pumping chambers and the pair of the Roots-type profile rotors in such a manner that the closer to one end of the shaft, the smaller the clearance of the pumping chamber.

A third aspect of the present invention is to provide multi-stage vacuum pump whose gist is to modify the structure of the first aspect, wherein one end of the each of the shafts is positioned at a side of the final stage pumping chamber.

BRIEF DESCRIPTION OF THE DRAWINGS

The above and other objects, features and advantages of the present invention will be more apparent and more readily appreciated from the following detailed description of preferred exemplary embodiments of the present invention, taken in connection with the accompanying drawings, in which.

DETAILED DESCRIPTION OF THE PRESENT INVENTION

Hereinafter, a preferred embodiment of the present invention will be described in great detail with reference to the attached drawings.

Figure 1:
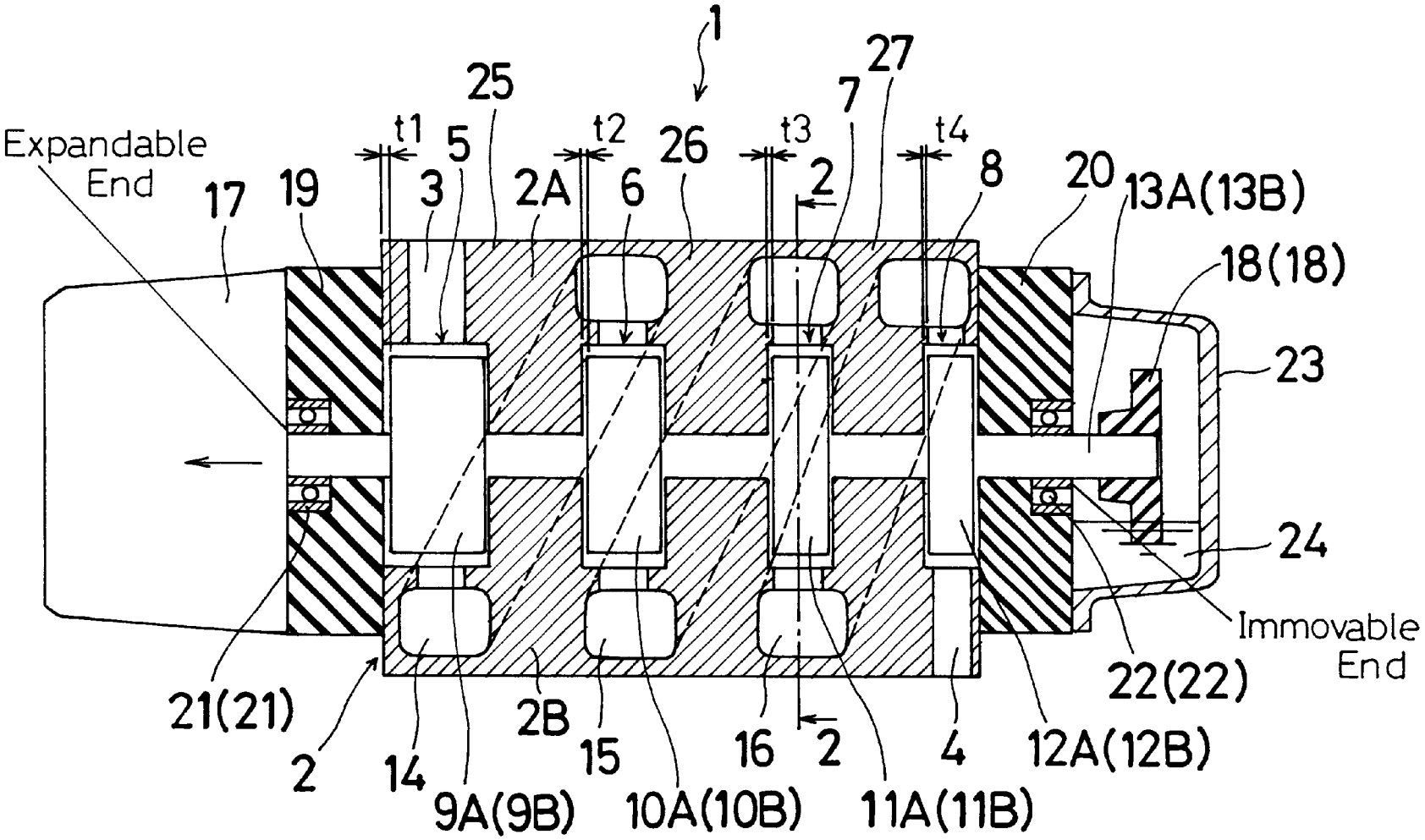
FIG. 1 is a cross-sectional view of a principal pr main portion of a "Roots"-type multi-stage vacuum pump in accordance with a preferred embodiment of the present invention.
Figure 2:
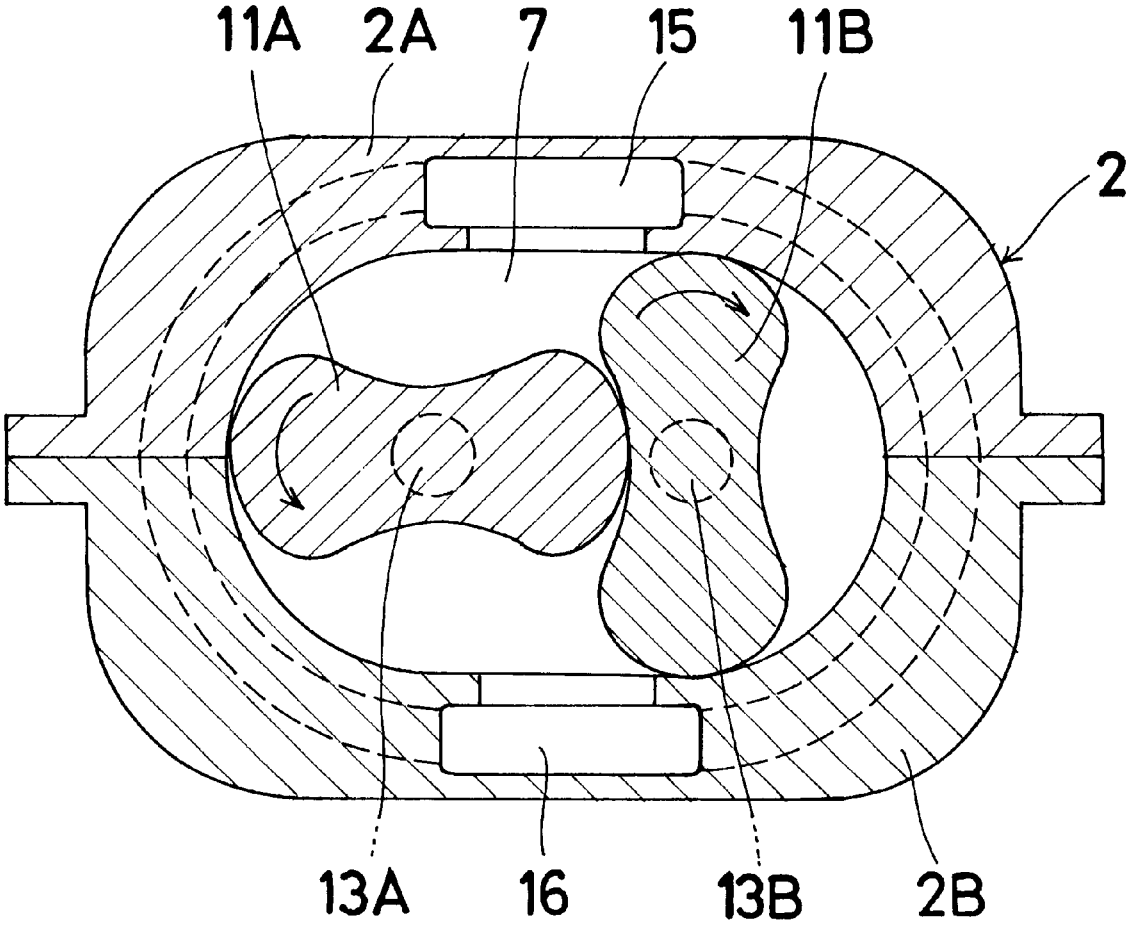
FIG. 2 is a cross-sectional view taken along line 2—2 in FIG. 1.

Referring first to FIGS. 1 and 2, there is illustrated a "Roots"-type multi-stage vacuum pump 1 which may be called simply a pump. FIG. 1 illustrates an inner structure of the pump 1 and FIG. 2 is a cross-sectional view taken along line 2—2 in FIG. 1. The pump 1 includes complementary housing members 2A and 2B which constitute a housing 2, a pair of side covers 19 and 20 which are coupled to opposite ends of the housing 2, an electric motor 17 secured to the side cover 19, and an oil cover 23 secured to the side cover 20.

At a central portion inside the housing 2, as depicted in FIG. 2, there are provided a pair of paralelly arranged shafts 13A and 13B which extend along an axial direction of the housing 2. The housing member 2A is formed at its upper side thereof with an integral inlet port 3. The inlet port 3 is in fluid communication with a space (not shown) to suck a gas stored therein for establishing an evacuated state of the space. The inlet port 3 is placed at a side of the motor 17. The housing 2 has an integral outlet port 4 from which the gas is exhausted outside the pump 1 after passing through the housing 2. The outlet port 4 is opened to an atmosphere at a lower portion of the housing 2.

Within the hosing 2 constructed by the cover member 19, the cover member 20, and the complementary housing members 2A and 2B, there are provided three axially spaced wall partitions 25, 26, and 27 to define four pumping chambers: a first stage pumping chamber 5, a second stage pumping chamber 6, a third stage pumping chamber 7, and a fourth stage pumping chamber 8. These four pumping chambers are designed to compress the sucked gas from the space to be evacuated in stepwise fashion such that each pumping chamber is designed to compress the gas. In the first, second, third, fourth stage pumping chamber 6, 6, 7, and 8, the common shafts 13A and 13B support Roots-type profile rotors 9A and 9B, 10A and 10B, 11A and 11B, and 12A and 12B, respectively. The shafts 13A and 13B are adapted for rotation within the housing 2 about theirs longitudinal or lengthwise axes in contra-rotational direction by virtue of the shaft 13A being connected to the motor 17 and by the shaft 13B being coupled to the shaft 1A by means of well-known timing gears 18 and 18. The Roots-type profile rotors 9A and 9B, 10A and 10B, 11A and 11B, and 12A and 12B are located in the respective first, second, third, fourth stage pumping chamber 5, 6, 7, and 8 relative to an inner circumferential surface of the housing 2 such that the Roots-type profile rotors 9A and 9B, 10A and 10B, 11A and 11B, and 12A and 12B can act as vacuum pumps.

The pumping chambers 5, 6, and 7 are in fluid communication with the pumping chambers 6, 7, and 8 by way of passages 14, 15, and 16, respectively, which are formed circumferential fashion in the housing 2. Each passage connects two adjacent pumping chambers, which causes the pumping chambers 5, 6, 7, and 8 to connect in series. Thus, the gas sucked into the inlet port 3 is brought into 4-stage compression process (i.e. is compressed four times in different pumping chambers), and is exhausted outside the pump 1 from the outlet port 4 such that the gas when being exhausted becomes hot due to four-time compressions. It is to be noted that the pumping chambers are same in internal circumferential surface. However, higher stage pumping chamber is smaller than lower stage pumping chamber in axial length or thickness, which causes the volumes of the respective pumping chambers 5, 6, 7, and 8 to decrease in stepwise fashion in this order.

A pair of bearings 21 and 21 (only one is shown) are provided in the side cover 19, while a pair of bearings 22 and 22 (only one is shown) are provided in the side cover 20. Opposite ends of the shaft 13A are supported by one of the bearings 21 and one of the bearings 22 for rotation, while opposite ends of the shaft 13B are supported by the other of the bearings 21 and the other of the bearings 22 for rotation. The bearings, 21, 21, 22, and 22 are arranged so as to ensure the parallel relationship between the shafts 13A and 13B. The shaft 13A is coupled to an output shaft of the motor 17 and is brought into concurrent rotation with the output shaft when the motor 17 is turned on. The other end of the shaft 13A and the other end of the shaft 13B extend outside the side cover 20 and are coupled with a pair of meshing timing gears 18 and 18 (only one is illustrated). The timing gears 18 and 18 ensure rotation of the shafts 13A and 13B at a same speed but in opposite directions (i.e. to synchronize the shafts 13A and 13B to rotate). The timing gears 18 and 18 are accommodated in an oil cover 23 to be protected which is secured to a right side of the side cover 20.

Supporting one end of the shaft 13A (13B) to the bearing 22 (22) is performed not to move or displace in its lengthwise direction, while supporting the other end of the shaft 13A (13B) to the bearing 21 (21) is performed to allow an expansion in its lengthwise direction.

Within an inner space of the oil cover 29, an amount of lubrication oil 24 is stored. Thus, making a portion of an outer periphery of each of the timing gears 18 and 18 immersed in the oil 24 while the timing gears 18 and 18 are in rotation results in that the meshing engagement between the timing gears 18 and 18 is always in lubricated state.

The above-described force transmission mechanism makes it possible, when the motor 17 is turned on, to rotate the pair of the shafts 13A and 13B in opposite directions, thereby sucking by way of the inlet port 3 the gas in the space to be evacuated.

In the first stage pumping chamber 5, an axial clearance t1 is defined between a right side (i.e. an inner side surface) of the cover member 19 of the housing 2 and each of the Roots-type profile rotors 9A and 9B. In the second pumping chamber 6, an axial clearance t2 is defined between a right side (i.e. an inner side surface) of the wall partition 25 of the housing 2 and each of the Roots-type profile rotors 10A and 10B.

In the third pumping chamber 7, an axial clearance t3 is defined between a right side (i.e. an inner side surface) of the wall partition 26 of the housing 2 and each of the Roots-type profile rotors 11A and 11B. In the fourth pumping chamber 8, an axial clearance t4 is defined between a right side (i.e. an inner side surface) of the wall partition 27 of the housing 2 and each of the Roots-type profile rotors 12A and 12B. A relationship is established which indicates $t1>t2>t3>t4$.

In operation, first of all the gas, which is to be exhausted from the outlet port 4 of the pump 1, is sucked into the inlet port 3. The resulting gas is moved or flown into the pumping chamber 5 and is compressed by the pair of the Roots-type profile rotors 9A and 9B which are fixedly mounted on the respective shafts 1A and 13B in rotation.

That is, the gas is, at first, brought into compression by the pair of the Roots-type profile rotors 10A and 10B which are fixedly mounted on the respective shafts 13A and 13B in rotation in the first stage pumping chamber 6. The resulting gas is fed by way of the passage 14 into the next stage or the second stage pumping chamber 6. The gas fed in the second stage pumping chamber 6 is, similar in the first stage pumping chamber 6, brought into compression. In the subsequent stage pumping chambers 7 and 8, similar compressions are, respectively, done. Thus the gas compressed in stepwise manner is fed from the fourth stage pumping chamber 8 to the outlet port 4 for being exhausted outside the pump 1.

During the above-described operation of the pump 1, gas compression is made or performed in each of the first, second, third, and fourth stage pumping chambers 5, 6, 7, and 8, which results in generation of compression heat at higher temperature in each pumping chamber. The generated compression heat is transferred to the Roots-type profile rotors 9A, 9B, 10A, 10B, 11A, 11B, 12A, and 12B, the pairs of the shafts 13A and 13B, and the housing 2.

Though the compression heat transferred to the housing 2 causes the temperature of the housing 2 to increase, an atmospheric exposure of an outer surface of the housing 2 makes it possible to restrict the possible temperature increase of the housing 2 as little as possible. In addition, providing a cooler (not shown) to the housing 2 is capable of cooling the housing 2.

On the other hand, while the multi-stage vacuum pump 1 is in operation, each of the pumping chambers 5, 6, 7, and 8 is made substantially vacuumed or heat-insulated state, which results in less heat radiation to the gas in each of the pumping chambers from the pair of shafts 13A and 13B, resulting in that as the temperature increase becomes larger which is caused by the compression heat the temperature difference between the housing 2 and the par of the shafts 13A and 13B is proportionally increased, whereby the shafts 13A and 13B are brought into thermal expansion.

Figure 3:
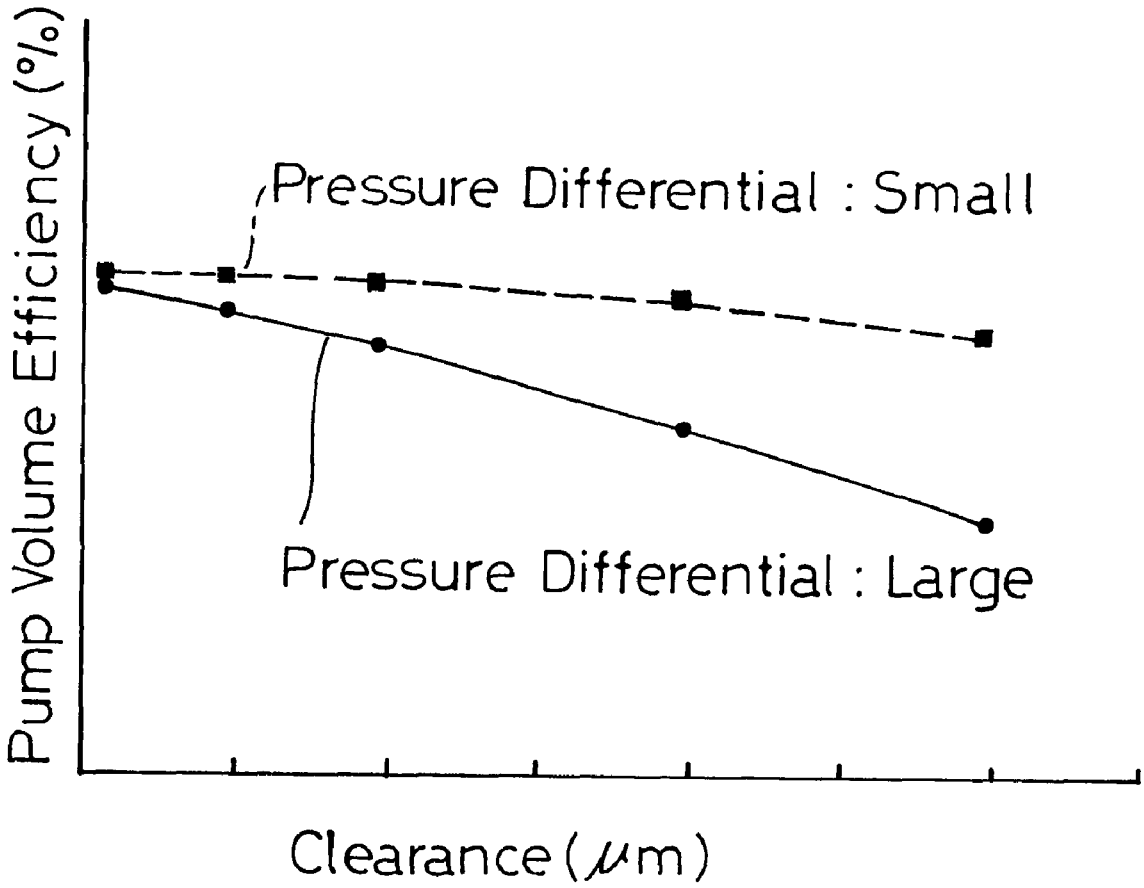
FIG. 3 is a graph indicating how pump volume efficiency (=real exhausted gas amount/designed exhaust gas amount) is affected by axial clearance between rotor and pumping chamber.

Referring now to a FIG. 3, there is depicted a graph which indicates how pump volume efficiency (=real exhausted gas amount/designed exhaust gas amount) is affected by axial clearance between rotor and pumping chamber. As well known, pump volume efficiency is made smaller when axial clearance between rotor and pumping chamber becomes larger. In addition, as a gas pressure difference across each of the pumping chambers (i.e. between suck and exhaust portions of each pumping chamber) becomes larger, the affection of the clearance on the pump volume efficiency is made larger and larger.

Figure 4:
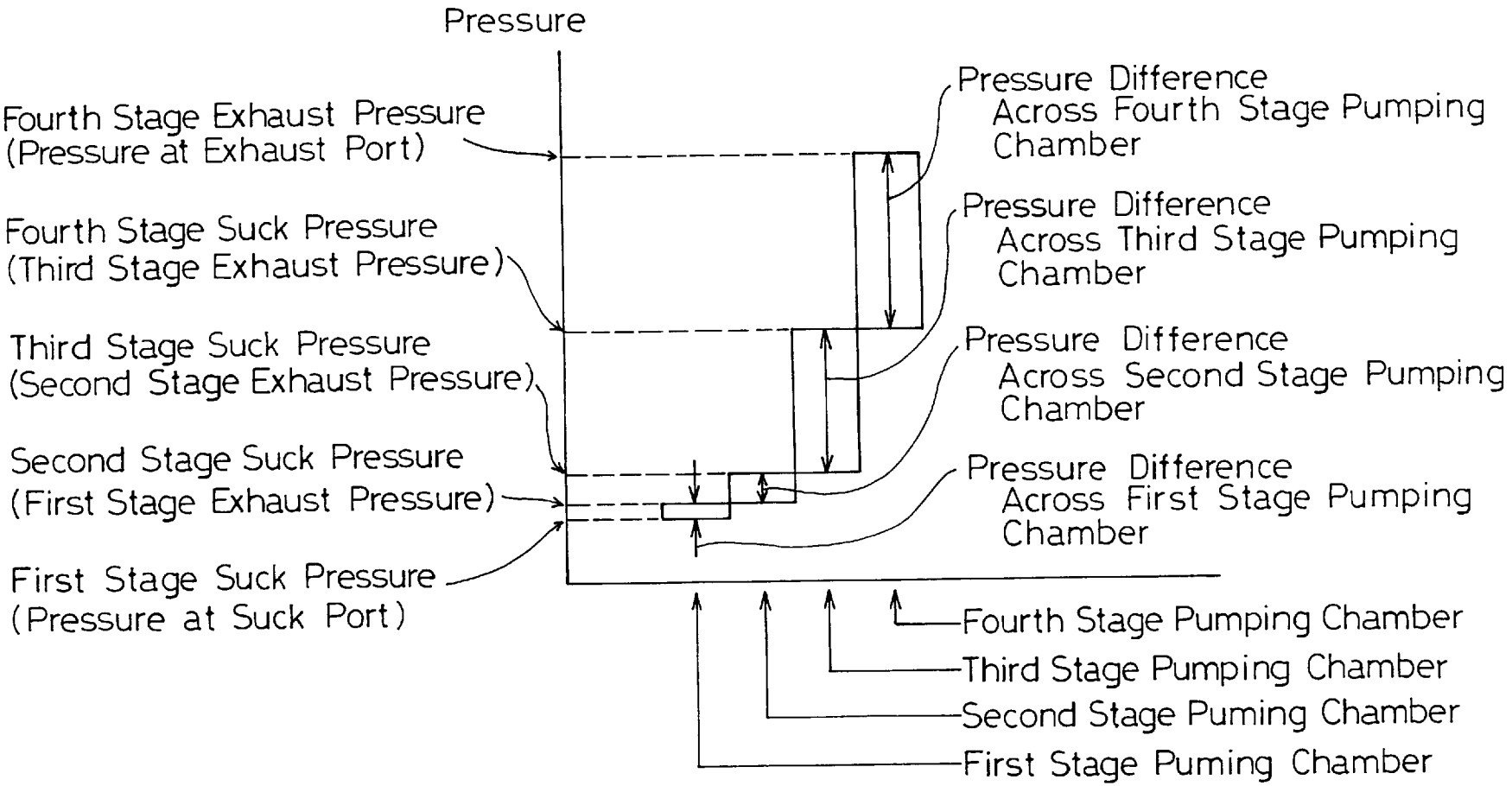
FIG. 4 is graph indicating a gas pressure difference across each of the pumping chambers.

Referring to FIG. 4, there is shown a graph which represents the above-mentioned gas pressure difference across each of the pumping chambers. The pressure at the gas suck side 3 of the first stage pumping chamber 5 is nearest to vacuum, while the pressure at the exhaust side 4 of the fourth stage pumping chamber 8 is nearest to a pressure to which the exhaust side 4 exposes (the atmospheric pressure if the exhaust side 4 is opened to the atmosphere). Of the gas pressure difference across each of the first, second, third, and fourth stage pumping chambers 5, 6, 7, and 8, the gas pressure difference across the last mentioned pumping chamber ranks highest. Thus, in order to keep the pump volume efficiency at a higher rate, it is effective to make the clearance t4 in the fourth stage pumping chamber 8 as small as possible.

As described above, one end of the shaft 13A (13B) is supported by the housing 2 by way of the bearing 22 (22) such that the shaft 13A (13B) is rotatable about its lengthwise axis but is immovable in its lengthwise direction, while the other end of the shaft 13A (13B) is supported by the housing 2 by way of the bearing 21 (21) such that the shaft 13A (13B) is rotatable about its lengthwise axis but is expandable in its lengthwise direction. Thus, such an expansion of each shaft makes it possible to compensate the possible axial-direction length change of each of the clearances t1, t2, t3, and t4 resulting from the difference of thermal expansion rate between the housing 2 and each of the shafts 13A and 13B.

As previously described, the clearances t1, t2, t3, and t4 of the respective first, second, third, and fourth stage pumping chambers 5, 6, 7, and 8 are set to establish the relationship: t1>t2>t3>t4. According to the multi-stage vacuum pump design theory, as to the total pump volume efficiency, a higher stage pumping chamber is of a higher contributing rate than its lower stage pumping chamber. This leads to that in the pump 1 having the above-described structure, the pump volume efficiency of the fourth stage pumping chamber 8 is higher than the pump volume efficiency of the first stage pumping chamber 5. On the other hand, as previously mentioned, enlarging uniformly the axial clearances of the respective pumping chambers for preventing the sliding engagement of the rotor to the housing inner wall causes the pump volume efficiency to lower or decrease in the respective pumping chambers. Thus, setting the clearances t1, t2, t3, and t4 to comply with the above relationship makes it possible to avoid the sliding engagement of the rotor to the housing inner wall with the possible lowering of the total pump volume efficiency restricted to the minimum. Lowering the pump volume efficiency of the lowest stage pumping chamber (the first stage pumping chamber 6) makes it possible to make the lowering of the total pump volume efficiency as small as possible.

In addition, the other end of each of the shafts 13A and 13B is made expandable in its lengthwise direction relative to the corresponding bearing 21. Thus, even if the shafts 13A and 13B are brought into thermal expansion while the pump 1 is in operation, the resulting extension of each of the shafts 13A and 13B can be free from the bearing 21. Thus, despite of the heat transfer of the compression heat to the shafts 13A and 13B, the resultant thermal expansion of each of the shafts 13A and 13B is free from the corresponding bearing 21, which prevents no generation of stress in each of the shafts 13A and 13B and the bearings 21 and 21. Thus, prolonging lives of the respective bearings 21 and 21 can be attained.

The invention has thus been shown and description with reference to a specific embodiment, however, it should be understood that the invention is in no way limited to the details of the illustrated structures but changes and modifications may be made without departing from the scope of the appended claims.

What is claimed is:

1. A multi-stage vacuum pump comprising a housing in which a plurality of pumping chambers are formed, the pumping chambers being arranged in series and being in fluid communication with one another, one of the pumping chambers which is at one end of the series acting as an initial stage pumping chamber, another of the pumping chambers which is at the other end of the series acting as a final stage pumping chamber, the housing being provided with an inlet port for sucking a gas from a space to be evacuated into the initial stage pumping chamber, the housing being provided with an outlet port for exhausting the gas from the final stage pumping chamber;

Roots-type pump sections occupying the respective pumping chambers, each of the Roots-type pump sec tions having a pair of intermeshed Roots-type profile rotors; and a pair of shafts adapted for rotation within the housing about their lengthwise axes in contra-rotational direction, the lengthwise axes each extending in a lengthwise direction, the pair of shafts being secured to the respective Roots-type profile rotors in each of the Roots-type pump sections, one end of each of the shafts being made immovable relative to the housing in the lengthwise direction, the other end of each of the shafts being made expandable in the lengthwise direction.

2. A multi-stage vacuum pump as set forth in claim 1, wherein an axially defined clearance between an inner surface of each of the pumping chambers and the pair of the Roots-type profile rotors is provided such that the closer the clearance is to the one end of the shaft, the smaller the clearance of the pumping chamber.

3. A multi-stage vacuum pump as set forth in claim 1, wherein the one end of the each of the shafts is positioned at a side of the final stage pumping chamber.

* * * * *